United States Patent [19]

Mott et al.

[11] 4,100,753

[45] Jul. 18, 1978

[54] MARINE STRUCTURE WITH RISER CONDUCTOR AND PIPELINE CONNECTION

[75] Inventors: George E. Mott, Metairie; Ronald D. Seguin, New Orleans, both of La.

[73] Assignee: Texaco Inc., New York, N.Y.

[21] Appl. No.: 767,401

[22] Filed: Feb. 10, 1977

[51] Int. Cl.[2] ..... E02B 17/00

[52] U.S. Cl. ..... 61/86; 61/110; 166/0.5

[58] Field of Search ..... 166/0.5, 0.6; 175/9; 61/86, 110, 111, 87

[56] References Cited

U.S. PATENT DOCUMENTS

| | | | |
|---|---|---|---|
| 3,219,119 | 11/1965 | Mathews, Jr. | 61/110 |
| 3,226,728 | 12/1965 | Walvoord | 166/0.5 |
| 3,376,708 | 4/1968 | Hindman | 166/0.5 |

*Primary Examiner*—Paul R. Gilliam
*Assistant Examiner*—Alexander Grosz
*Attorney, Agent, or Firm*—Thomas H. Whaley; Carl G. Ries; Robert B. Burns

[57] ABSTRACT

A marine structure having a conductor adapted to receive a flow of fluid from a subsea pipeline. Said structure includes means to facilitate engagement of the fluid conductor with the pipeline, by means of a provisional conductor. The latter is pivotally connected into the structure during the building stages in a manner to permit adjustment thereof after the structure has been submerged at a working site.

9 Claims, 5 Drawing Figures

FIG. 2
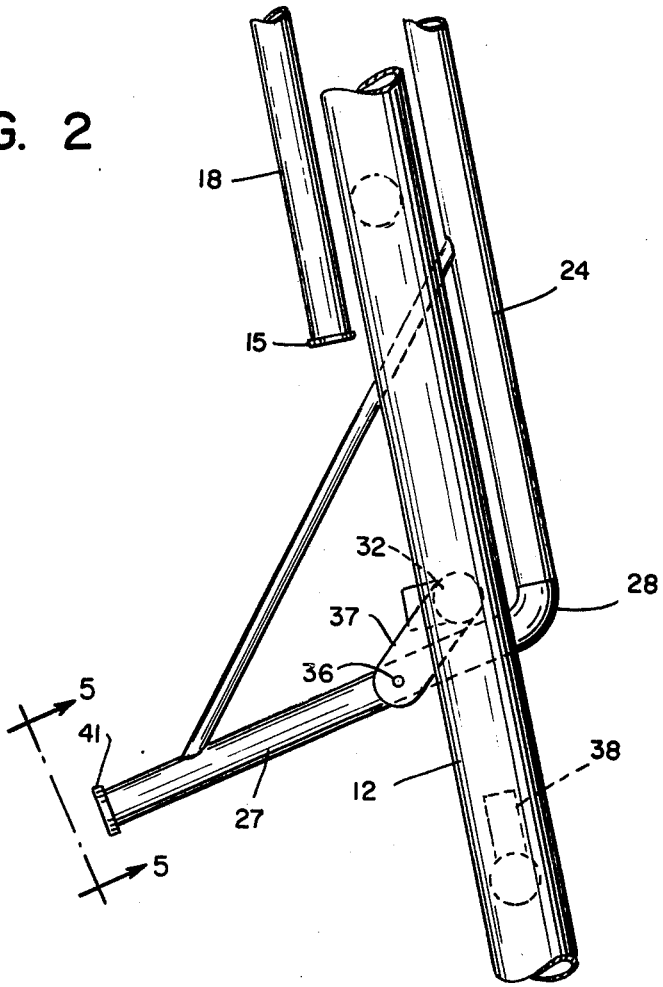
FIG. 5
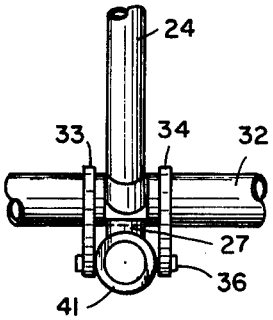
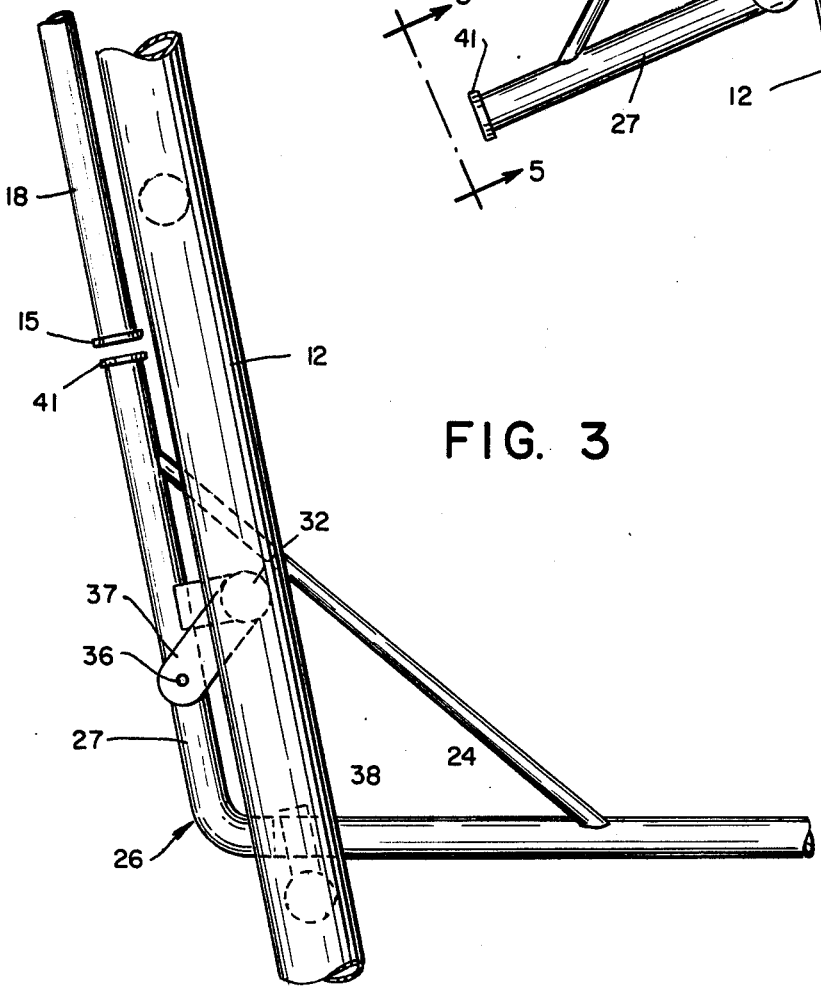
FIG. 3

MARINE STRUCTURE WITH RISER CONDUCTOR AND PIPELINE CONNECTION

BACKGROUND OF THE INVENTION

In the offshore segment of the petroleum industry one of the prevalent problems has been the connecting of an offshore platform or marine structure to a pipeline which normally carries petroleum products to an onshore storage area or from a well. Usually one or more well heads at the ocean floor are connected to a common line which conducts the products to a riser or conduit supported by the platform. The riser directs the crude liquid or gas product upwardly to a separation system at the platform's deck prior to the product being conducted away by another such pipeline, or shipped away by tanker.

As a matter of practice, the connection between the pipeline and the fluid conductor at the marine platform, is made by welding the pipe joint to the fluid conductor through the use of divers and/or highly technical equipment which is lowered to the sea floor. In the instance of relatively deep waters, the normal problem of making the above noted connection is substantially compounded. This results primarily from the hyperbaric atmosphere which limits the use of personnel and greatly increases the cost of such an operation.

Toward simplifying this laying of the desired pipeline the present invention provides a means whereby the lower end of the fluid carrying conductor or riser is adjustably connected to the platform. In the resting position the conductor is disposed in a substantially upright disposition so that its lower open end is adjacent to the ocean floor.

A provisional conductor which subsequently forms a portion of the pipeline, is detachably connected to the marine structure in a manner to permit pivotal movement of said provisional member in a substantially vertical plane. Pivotal movement will thus position the lower end of said provisional conductor in approximate alignment with the upright fluid conductor. Downward movement of the latter will then engage the respective members into a fluid tight connection between the pipeline and the conductor.

It is therefore an object of the invention to provide means for connecting a marine structure supported fluid conductor to a pipeline, without the necessity of operating underwater or utilizing divers. A further object is to provide an offshore platform including means for connecting a conductor or riser member to the pipeline through the use of a pivotally connected pipeline extension. A still further object is to provide an offshore structure of the type contemplated which simplifies the laying of a pipeline from the water's surface to the floor, after being initially connected to the structure's conductor lower end through a pivotal joint.

DESCRIPTION OF THE DRAWINGS

FIG. 2 is a segmentary view of a portion of the structure shown in FIG. 1.

FIG. 3 is a side elevation of the structure shown in FIG. 2.

FIG. 5 is a view taken along line 5—5 of FIG. 2.

Figure 1:
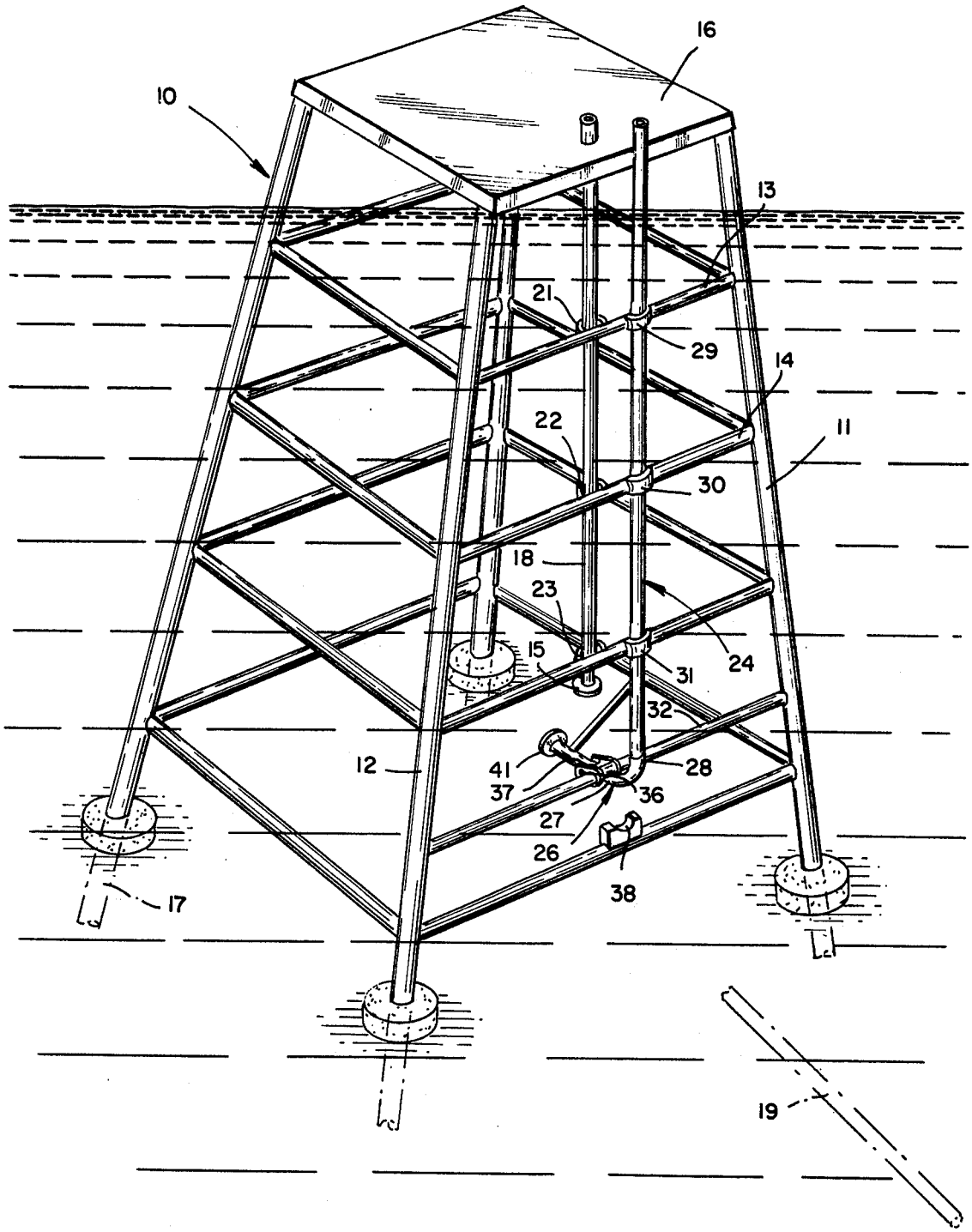
FIG. 1 is an environmental view illustrating the marine structure supported product riser or conductor.
Figure 4:
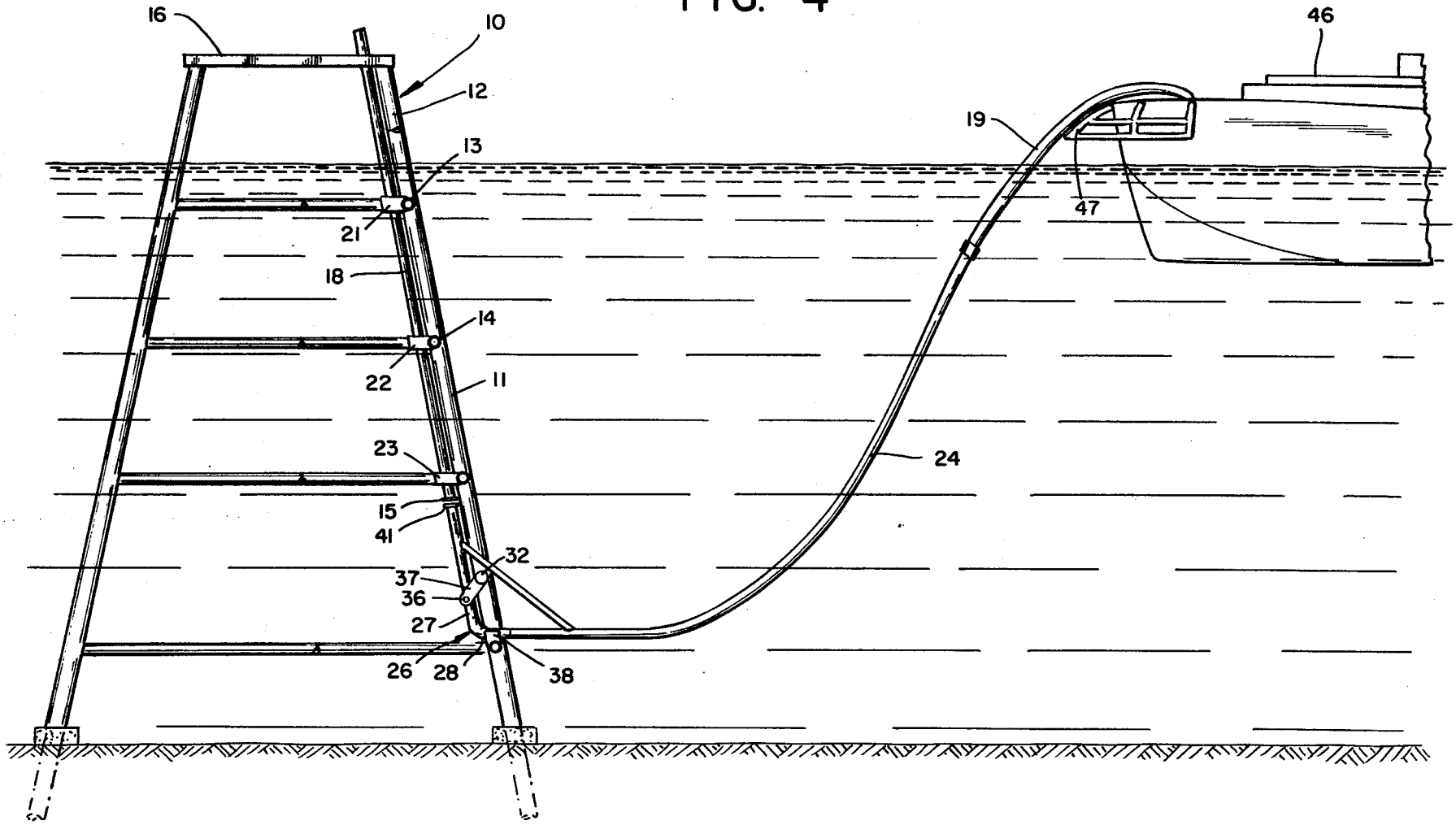
FIG. 4 illustrates the instant structure as connected to a pipeline.

Referring to the drawings, an offshore or marine platform 10 of the type contemplated is shown as comprising a plurality of upstanding columns or legs 11 and 12 which include lateral support members or braces 13 and 14 extending therebetween. A working deck 16 is supported at the legs' upper ends. When positioned at an offshore working site platform 10 is arranged substantially vertically such that the respective support columns assume an upright disposition. After the structure is positioned in place from a carrying barge or the like, piles 17 are driven through the respective legs into the substrate, whereby to fixedly anchor the entire unit and permit operation thereof at the working site.

Toward facilitating the producing process, the crude product is normally led from a series of well heads dispersed at the ocean floor. It is then conducted through a pipeline and/or manifold system, and thence upward through a riser or fluid conductor member 18 which depends from platform 10. Deck 16 normally carries equipment to initially treat or process the crude product. One such initial treatment is to separate gas and/or water from liquid product prior to the latter being further pipelined to shore, or loaded onto a cargo vessel or tanker.

Elongated tubular fluid conductor 18 is disposed preferably adjacent one side of the marine structure. Said conductor 18 comprises in one form, a series of end connected pipe sections of sufficient diameter to carry the flow of fluid which will be pumped or forced from the subsea pipeline. This fluid conductor, also referred to herein as a riser, terminates at the platform deck such that it can be readily connected to appropriate treating apparatus such as a gas separator or the like. The lower end of said fluid conductor 18 is provided with a flange or a suitable coupling member 15 for achieving a fluid tight connection with pipeline 19 as will be hereinafter noted.

Conductor 18 is adjustably positioned with respect to the various lateral brace members 13 and 14. Preferably it is located between adjacently positioned support columns 11 and 12, by a series of vertically arranged clamping members 21, 22 and 23. Said clamping members are adapted to not only position conductor 18 horizontally, but also to position it vertically such that the entire conductor can be adjusted upwardly or downwardly for the purpose of achieving the fluid tight connection with pipeline 19 as will be hereinafter noted.

A provisional flow conductor 24 is similarly connected to one side of marine structure 10, being positioned adjacent to the above described fluid conductor 18. Said provisional conductor 24 comprises in essence an elongated upper end defined by a plurality of end connected pipe lengths which will subsequently form a portion of the floor supported pipeline 19. Said provisional conductor 24 is provided at the lower end with a connecting segment 26.

Connecting segment 26 includes in essence a section of pipe or conductor having a diameter comparable to the diameter of fluid conductor 18, and being so formed to define a desired angle between the various respective legs 27 and 28. Said angle is such that a proper connection can be made with fluid conductor 18, after provisional conductor is lowered to the ocean floor.

Thus, when provisional conductor 24 is initially fabricated as an integral part of marine structure 10, it is held in place by a plurality of spaced apart clamps or similar restraining members 29 and 31. Each of said clamps is remotely operable to an open position whereby the entire provisional conductor 24 will be released from its fixed connection to the platform 10.

The lower end of said provisional conductor 24 terminates at the ocean floor, and adjacent to the lower end of the fluid conductor 18. The pivotal function of said provisional conductor is achieved through use of a pivotal connection made between the connecting segment 26, and the lateral brace 32. Brace 32 is provided with spaced apart pivot blocks 33 and 34 in a manner to slidably receive a hinge pin or shaft 36 which depends from, and is fixedly positioned to the connecting segment 26. Said hinge pin 36 is so positioned by an extension arm 37 to maintain a position in substantial vertical alignment with the fluid conductor 18. Thus, when the provisional conductor 24 is lowered to its operating position at the ocean floor, the leg 27 of said conductor segment 26 will be in an upstanding position in alignment with the lower end of fluid conductor 18.

To facilitate proper positioning of the connecting segment 26 when the provisional conductor 24 is in the lowered position, one or more guide members are provided. For example, saddle guide 38 is disposed on lower lateral brace 39 in such a position to constitute an abutment with leg 28 of connecting segment 26 when the latter is adjusted to a substantially vertical position. A similar transverse guide means can be provided to receive and properly align leg 27 of said connecting segment 26 with the lower end of the fluid conductor 18.

As above mentioned, with respect to the fluid conductor 18, connecting segment 26 remote end can be provided with a suitable flange or coupling member 41 adapted to engage the corresponding member 15 of said fluid conductor 18. This engagement in accordance with the precepts of the invention, can be remotely instituted through a hydraulic or pneumatic system which is actuated at platform deck 16. Thus, the physical joining of pipeline 19 with the conductor 18 can be made without the need for diver participation, and with a minimal possibility of technical difficulty.

Operationally, the entire marine structure 10 is normally assembled in a shore based fabrication yard. Said assembly includes the positioning of not only the fluid conductor 18 a predetermined distance from the lower end of the marine structure 10, but also the positioning of the provisional conductor 24 so as to be operable as herein noted.

Upon completion, the marine structure 10 is normally floated or barged to a desired offshore working site, and after being lowered into the water is fixedly positioned therein by piling or similar means. With the platform firmly fixed, the upper end of the provisional conductor 24 as well as fluid conductor 18, will protrude beyond the structure's working deck.

To commence the connecting operation a lay barge or similar vessel 46 is utilized to add additional sections of pipe to the upper end of the provisional conductor 24. Said barge 46 is further equipped to engage the upper end of said provisional conductor 24 and progressively draw it away from marine structure 10 after the retaining clamps 29 and 31 have been released. In the normal manner laying a length of pipe, the provisional conductor 24, which now assumes the function of a segment of pipeline 19 will be supported if needed by a stinger 47 or similar member depending from the lay barge. As the barge progresses away from structure 10, tension is applied to the provisional member and simultaneously additional lengths of pipe are added thereto.

While the addition of such pipe lengths, provisional conductor 24 will assume the desired, general "S" configuration between the surface of the water and the floor of the ocean. In its ultimate position the lower end of the provisional structure 24, i.e. the elongated pipe section, will come to rest such that connecting segment 26 is generally uprightly disposed and in alignment with the lower end of the fluid conductor 18.

In such a position, connection between said two members is achieved by releasing the holding clamps 21, 22 and 23 which retain and position fluid conductor 18. The latter, then being supported by a derrick or similar means at the upper end, is lowered into physical contact with the connecting segment coupling member. If a proper mating action is achieved, the coupling of said members can be made remotely by actuation of the automatic coupling system at deck 16.

With pipeline 19 now connected to the fluid conductor 24, the remaining lengths of pipe can be progressively added to the provisional conductor such that the latter lays in its entirety on the ocean floor, thereby forming an integral part of the pipeline.

Other modifications and variations of the invention as hereinbefore set forth can be made without departing from the spirit and scope thereof, and therefore, only such limitations should be imposed as are indicated in the appended claims.

We claim:

1. A marine structure having upper and lower ends, for use in an offshore body of water, being adapted to engage a fluid carrying pipeline supported at the ocean floor, said marine structure including at least one upstanding support column having upper and lower ends, and a deck carried at the upper end of said at least one support column, a fluid conductor operably depending from said at least one support column having one end disposed at said deck, and a coupling end disposed adjacent to the marine structure's lower end, said fluid conductor being longitudinally slidable to a limited degree, along said at least one support column, an elongated provisional conductor comprising; a pipe section releasably disposed adjacent to said fluid conductor, prior to being connected with said pipeline and a connecting segment depending from and forming an adjunct to said pipe section at the marine structure's lower end, operably connecting said structure with said provisional conductor at a point spaced from the end of said connecting segment whereby pivotal movement of said provisional conductor to dispose the pipe section at the ocean floor, will align said connector segment with said conductor coupling end to permit fluid tight engagement of the latter two members.

2. In the device as defined in claim 1, including clamping means releasably engaging said fluid conductor to permit limited downward movement thereof to permit engagement of said coupling end with said connecting segment when the two are in alignment.

3. In the device as defined in claim 1, including connecting means depending from said fluid conductor and said connector segment respectively, being operable from a remote position to form said fluid tight engagement therebetween.

4. In the device as defined in claim 1, including guide means depending from said marine structure and positioned to receive said provisional conductor during pivotal movement of the latter, whereby to align said fluid conductor and said connecting segment for engagement thereof.

5. In the device as defined in claim 1, wherein said marine structure includes; a plurality of upstanding columns having lateral braces extending therebetween, said fluid conductor depending from said respective lateral braces and guide means carried on at least one of said lateral braces being positioned to limit movement of the conductor.

6. In the device as defined in claim 5, where at least one of said lateral braces includes a hinged block, and said connecting segment includes a hinge pin, the latter being received in said hinged block to permit rotation of said provisional conductor.

7. Method for forming a fluid tight connection between a fixed fluid conductor carried on a marine structure, and an adjustably positioned fluid conductor disposed in a substantially upstanding position on a marine structure, and a subterranean pipeline disposed at the floor of a body of water which includes the steps of;

providing said marine structure with a provisional flow conductor which includes an elongated pipe section releasably positioned adjacent to said structure, said conductor having a connecting segment which depends from the lower end thereof, and having connecting means at the connecting segment end, said provisional conductor being pivotally connected to said structure at a point spaced from said connecting means, pivotally adjusting said provisional conductor away from said marine structure to align said connecting segment with said fluid conductor, remotely adjusting the fluid conductor in a downward direction to engage said connecting means whereby to form a sealed engagement therewith.

8. In the method as defined in claim 1, including the step of adding additional lengths of pipe to said provisional conductor pipe section as said section is lowered to the ocean floor.

9. In the method as defined in claim 1, including the step of progressively supportably lowering said pipe section into a submerged position at the ocean floor as additional pipe lengths are added thereto.

* * * * *